US007995960B2

(12) United States Patent
Kamimura

(10) Patent No.: US 7,995,960 B2
(45) Date of Patent: Aug. 9, 2011

(54) IMAGE FORMING APPARATUS HAVING UNITS FOR CLEANING PHOTOSENSITIVE MEMBERS

(75) Inventor: Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 229 days.

(21) Appl. No.: 12/340,988

(22) Filed: Dec. 22, 2008

(65) Prior Publication Data

US 2009/0169258 A1 Jul. 2, 2009

(30) Foreign Application Priority Data

Dec. 28, 2007 (JP) ..... 2007-338621

(51) Int. Cl.
*G03G 21/00* (2006.01)

(52) U.S. Cl. ..... 399/357; 399/123; 399/149; 399/150; 399/299; 399/300; 399/302; 399/308; 399/343

(58) Field of Classification Search ..... 399/123, 399/149, 150, 299, 300, 302, 308, 343, 357
See application file for complete search history.

(56) References Cited

U.S. PATENT DOCUMENTS

| | | | | |
|---|---|---|---|---|
| 2003/0185588 | A1* | 10/2003 | Takami et al. | 399/111 |
| 2004/0052557 | A1 | 3/2004 | Fukuta | |
| 2005/0100364 | A1 | 5/2005 | Nishimura | |

FOREIGN PATENT DOCUMENTS

| | | | |
|---|---|---|---|
| JP | 4-219779 | A | 8/1992 |
| JP | 05-053482 | | 3/1993 |
| JP | 5-134584 | A | 5/1993 |
| JP | 11-327191 | A | 11/1999 |
| JP | 2004-109319 | A | 4/2004 |
| JP | 2005-114756 | A | 4/2005 |

OTHER PUBLICATIONS

JP Office Action dtd Jan. 5, 2010, JP Appln. 2007-3388621, partial English translation.
Extended EP Search Report May 6, 2009, EP Appln. 08022066.8.
Notification of Reasons for Refusal dispatched Oct. 12, 2010 in Japanese Application No. 2010-107302 and English translation thereof.

* cited by examiner

*Primary Examiner* — Ryan D Walsh
(74) *Attorney, Agent, or Firm* — Banner & Witcoff, Ltd.

(57) ABSTRACT

An image forming apparatus includes photosensitive members which are aligned along a conveying direction of a transfer medium and on each of which an electrostatic latent image is to be formed; developing units which supply a plurality of colors of developing agent to the photosensitive members, respectively; and cleaning rollers which slidably contact the photosensitive members to collect at least one of paper powder and developing agent adhering to surfaces of the photosensitive members, respectively. A most upstream cleaning roller which slidably contacts a most upstream photosensitive member in the conveying direction is provided with a paper powder absorption shaft which attracts and absorbs paper powder from the cleaning roller. A most downstream cleaning roller which slidably contacts a most downstream photosensitive member in the conveying direction is not provided with the paper powder absorption shaft.

12 Claims, 3 Drawing Sheets

IMAGE FORMING APPARATUS HAVING UNITS FOR CLEANING PHOTOSENSITIVE MEMBERS

CROSS-REFERENCE TO RELATED APPLICATION

This application claims priority from Japanese Patent Application No. 2007-338621, filed on Dec. 28, 2007, the entire subject matter of which is incorporated herein by reference.

TECHNICAL FIELD

Aspects of the present invention relate to an image forming apparatus including a plurality of photosensitive members and a plurality of cleaning rollers that slidably contact with the plurality of photosensitive members, respectively.

BACKGROUND

A related-art image forming apparatus, such as a laser printer, generally includes a plurality of development units that accommodate different colors of toner; a plurality of photosensitive drums that are supplied with the toner from the plurality of development units though development rollers, respectively; a belt disposed opposite the plurality of photosensitive drums; and a plurality of transfer units that transfer the toner on the plurality of photosensitive drums toward the belt, respectively. In this related-art image forming apparatus, when a sheet conveyed by the belt passes between each of the photosensitive drums and the corresponding transfer unit, a transfer bias corresponding to the charging polarity of toner is applied to corresponding transfer units, whereby the different colors of toner held on the respective photosensitive drums are separated by the respective transfer units. Accordingly, the toner is sequentially transferred onto a sheet so that color printing of the sheet is performed.

In order to reduce or prevent toner, which has not been separated by a transfer unit, from being left on a photosensitive drum, a related-art image forming apparatus removes electricity from the toner still remaining on the photosensitive drum after transfer operation to thus disperse the toner over the photosensitive drums. Herein, the toner, which is remaining on the photosensitive drum after transfer operation, is also referred to as "residual transfer toner". Then, the residual transfer toner is collected by the development rollers (see JP-A-5-53482). In another related-art, collecting the residual transfer toner is performed by changing a voltage applied to cleaning rollers slidably contacting with the photosensitive drums, respectively so that the cleaning rollers temporarily hold the residual transfer toner. Then, at a specific timing, the residual transfer toner is moved from the cleaning rollers to the photosensitive drums, thereby collecting the residual transfer toner by the development rollers.

Incidentally, in the above-described related-art image forming apparatus, if paper dust adhering to a sheet is moved to the photosensitive drum at the time of transfer of toner to the sheet, transfer operation performed in subsequent processes is sometimes disturbed by the paper dust, which obstructs appropriate printing operation. For this reason, in the related-art image forming apparatus, it is necessary to provide a mechanism for collecting paper dust. However, in the related-art art, if the mechanism for collecting paper dust is provided for each of the development unit in addition to the cleaning roller, the size of overall image forming apparatus increases.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus including a plurality of cleaning rollers and being capable of collecting paper powder, which contributes to reduce the size of the apparatus.

According to an exemplary embodiment of the present invention, there is provided an image forming apparatus includes: a plurality of photosensitive members which are aligned along a conveying direction of a transfer medium and on each of which an electrostatic latent image is to be formed; a plurality of developing units which supply a plurality of colors of developing agent to the photosensitive members, respectively; and a plurality of cleaning rollers which slidably contact the photosensitive members to collect at least one of paper powder and developing agent adhering to surfaces of the photosensitive members, respectively, wherein a most upstream cleaning roller which slidably contacts a most upstream photosensitive member in the conveying direction is provided with a paper powder absorption shaft which attracts and absorbs paper powder from the cleaning roller, and wherein a most downstream cleaning roller which slidably contacts a most downstream photosensitive member in the conveying direction is not provided with the paper powder absorption shaft.

According to another exemplary embodiment of the present invention, there is provided an image forming apparatus includes: a conveying unit which conveys a transferred medium in a conveying direction; first and second photosensitive members which are aligned in the conveying direction, wherein the first photosensitive member is disposed upstream than the second photosensitive member in the conveying direction; first and second developing unit which supply toner to the first and second photosensitive members, respectively; and first and second cleaning unit which are provided for the first and second photosensitive members to clean the first and second photosensitive members, respectively, wherein the first and second cleaning unit has different configuration.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Overall Configuration of a Color Printer

Figure 1:
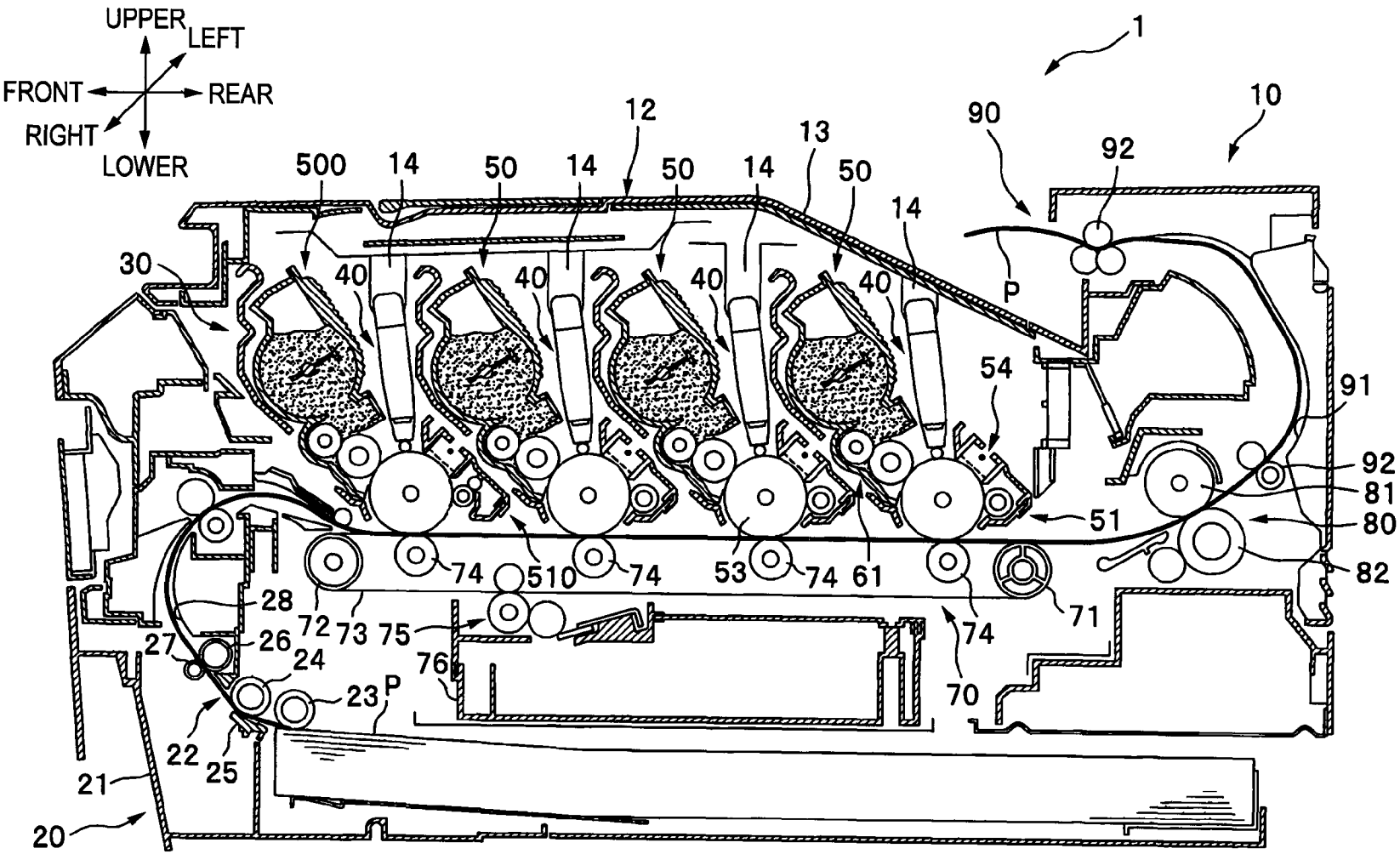
FIG. 1 is a cross-sectional view showing the overall configuration of a color printer.

Next, an exemplary embodiment of the present invention is described in detail with reference to the drawings. In the drawings, FIG. 1 is a cross-sectional view showing the overall configuration of a color printer, and FIG. 2 is an enlarged cross-sectional view showing the configuration of the process cartridge.

In the following descriptions, directions will be described with reference to user's directions when the color printer is in use. Specifically, in FIG. 1, the left side of the sheet is taken as "front"; the right side of the sheet is taken as "rear"; a direction away from the viewer in the sheet is taken as "left"; and a direction toward the viewer in the sheet is taken as "right." The vertical direction of the sheet is taken as the "vertical (upper and lower) direction."

Figure 2:
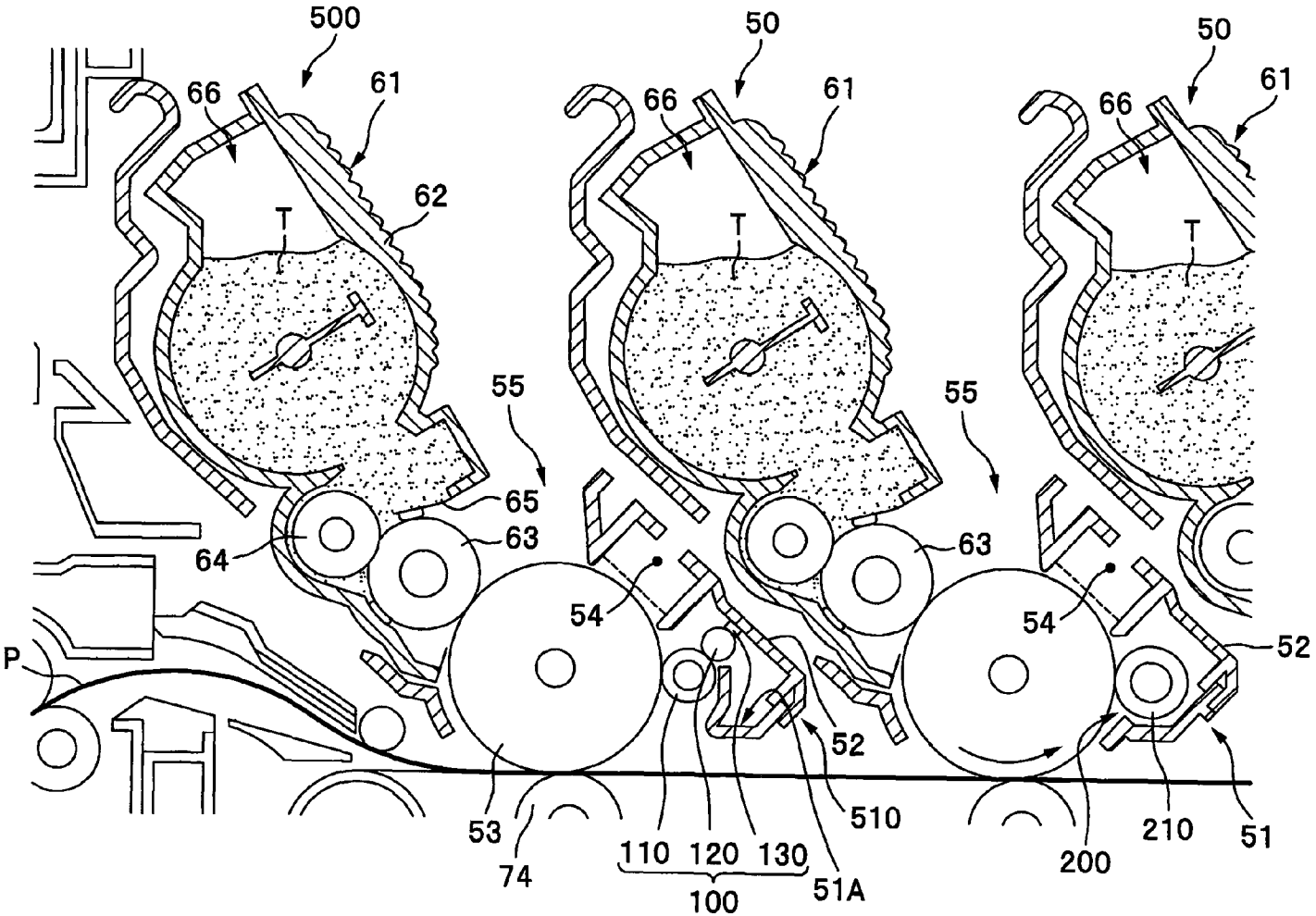
FIG. 2 is an enlarged cross-sectional view showing the configuration of process cartridges.

As shown in FIG. 1, a color printer 1 includes, within a main-body housing 10, a sheet feeding section 20 for feeding a sheet P; an image forming section 30 for forming an image on the thus-fed sheet P; and a sheet discharging section 90 that discharges the sheet P on which an image is formed.

An upper cover 12 is provided at an upper portion of the main-body housing 10 so as to be vertically pivotable about a hinge (not shown) provided at a rear side as a fulcrum. The main-body housing 10 has an opening at an upper portion thereof. The upper cover 12 is capable of opening and closing the opening of the main-body housing 10. An upper surface of the upper cover 12 constitutes a sheet discharging tray 13 for stacking the sheets P discharged from the main-body housing 10, and a lower surface of the same is provided with a plurality of holding members 14 each of which holds LED units 40.

The sheet feeding section 20 includes a sheet feeding tray 21 that is provided in a lower inner portion of the main-body housing 10 and that is removably attached to the main-body housing 10; and a sheet feeding mechanism 22 that conveys the sheets P from the sheet feeding tray 21 to the image forming section 30. The sheet feeding mechanism 22 is provided on the right side of the sheet feeding tray 21 and includes a feed roller 23, a separation roller 24, and a separation pad 25.

In the sheet feeding section 20 configured as described above, the sheets P housed in the sheet feeding tray 21 are separated one at a time and fed upwardly. After paper powder is removed during the course of the sheet passing between a paper powder removal roller 26 and a pinch roller 27, the sheet passes through a conveyance path 28, to thus be turned rearward and fed to the image forming section 30.

The image forming section 30 includes four LED units 40; four process cartridges 50 (500); a transfer unit 70; and a fixing unit 80.

Process cartridges 50 (500) are aligned in a longitudinal direction between the upper cover 12 and the sheet feeding section 20. The process cartridge 500 is disposed at the most upstream position with respect to the direction of conveyance of the sheet among the four process cartridges 50 (500). As shown in FIG. 2, each of the process cartridges 50 (500) includes a drum unit 51 (510) and a developing cartridge 61 removably attached to the drum unit 51 (510).

The developing cartridges 61 are different from each other only in terms of the color of toner T (developing agent) accommodated in a toner accommodating chamber 66 and are identical with each other in terms of a structure. In the exemplary embodiment, black color toner T, which is though to be remained (has a property of remaining) on the corresponding photosensitive drum 53 after transfer operation least among the plurality of toner T accommodated in other developing cartridges 61, is accommodated in the developing cartridge 61 disposed at the most upstream position with respect to the direction of conveyance of the sheet P.

The drum units 51 (510) are configured so that only a portion of the drum unit 510 disposed at the most upstream position with respect to the direction of conveyance of the sheet P is different among the four drum units 51 (510) and have the same structure in other respects. The portion of the drum unit 510 different from that of the other drum units 51 will be described in detail later.

Each of the drum units 51 (510) includes a drum frame 52; a photosensitive drum 53 rotatably supported by the drum frame 52; and an electrifier 54. The drum unit 510 located at the most upstream position with respect to the direction of conveyance of the sheet P is provided with a first cleaning mechanism 100, and each of the other three drum units 51 is provided with a second cleaning mechanism 200. The first cleaning mechanism 100 and the second cleaning mechanism 200 will be described later.

The drum frame 52 is configured so that an exposure space 55 through which the photosensitive drum 53 is viewed from the outside is defined as a result of attachment of the developing cartridge 61. The LED unit 40 is inserted into the exposure space 55 so as to oppose an upper portion of the surface of the photosensitive drum 53 when the upper cover 12 is closed.

The developing cartridge 61 includes a development frame 62; a development roller 63 and a supply roller 64 that are rotatably supported by the development frame 62; and a layer thickness regulation blade 65. Further, the developing cartridge 61 includes a toner accommodating chamber 66 that accommodates toner T.

As shown in FIG. 1, a transfer unit 70 is interposed between the sheet feeding section 20 and the respective process cartridges 50. The transfer unit 70 includes a drive roller 71, a driven roller 72, a conveyance belt 73, a transfer roller 74, and a cleaning section 75.

The drive roller 72 and the driven roller 71 are provided in parallel while being spaced apart from each other in the longitudinal direction. The conveyance belt 73 is configured as an endless belt wound around the dive roller 72 and the driven roller 71. An external surface of the conveyance belt 73 contacts with the respective photosensitive drums 53. Four transfer rollers 74 that nip the conveyance belt 73 in conjunction with the respective photosensitive drums 53 are disposed inside of the conveyance belt 73 so as to oppose the respective photosensitive drums 53. A transfer vias is applied to the transfer rollers 74 by constant current control operation during transfer operation.

The cleaning section 75 is disposed below the conveyance belt 73 and configured so as to remove the toner T adhering to the conveyance belt 73 and cause the thus-removed toner T to fall into a toner receiving section 76 disposed below the cleaning section 75.

The fixing unit 80 is disposed at the rear of the respective process cartridges 50 and the transfer unit 70 and includes a heating roller 80 and a pressing roller 82 that is disposed opposite the heating roller 81 and presses the heating roller 81.

In the image forming section 30 configured as described above, surfaces of the respective photosensitive drums 53 are uniformly charged with a positive polarity by the respective electrifiers 54 and exposed with light emitted from the respective LED units 40. Thereby, the electric potential of exposed areas becomes lower, and electrostatic latent images based on image data are formed on the respective photosensitive drums 53.

The toner T in the toner accommodating chamber 66 is fed to the development roller 63 with rotation of the supply roller 64, and the thus-supplied toner enters a space between the development roller 63 and the layer thickness regulation blade 65 with rotation of the development roller 63, whereupon the toner is held on the development roller 63 as a thin layer of specific thickness. The toner T held on the development roller 63 is positively charged through friction between the supply roller 64 and the development roller 63 and between the development roller 63 and the layer thickness regulation blade 65.

The toner T held on the development roller 63 is supplied to the electrostatic latent image formed on the photosensitive drum 53 when the development roller 63 contacts the photosensitive drum 53 in an opposing manner. Thereby, the toner T is selectively held on the photosensitive drum 53, so that the electrostatic latent image is visualized and that a toner image is formed by reversal development.

As a result of the sheet P fed on the conveyance belt 73 passing between the respective photosensitive drums 53 and the respective transfer rollers 74 disposed inside of the conveyance belt 73, the toner images formed on the respective photosensitive drums 53 are transferred to the sheet P. When the sheet P passes between the heating roller 81 and the pressing roller 82, the toner images transferred onto the sheet P are thermally fixed.

The sheet discharging section 90 includes a sheet discharging path 91 that is formed so as to upwardly extend from an exit of the fixing unit 80 and turn to the front side, and a plurality of conveyance roller pairs 92 for conveying the sheet P. The sheet P on which the toner images are transferred and thermally fixed is conveyed along the discharging path 91 by the conveyance rollers 92, discharged to the outside of the main-body housing 10, and stacked on the sheet discharging tray 13.

Detailed Configuration of the Cleaning Mechanism

Next, detailed configuration of the drum unit 510 located at the most upstream position, the first cleaning mechanism 100, and the second cleaning mechanism 200 will now be described.

As shown in FIG. 2, the first cleaning mechanism 100 is provided only for the drum unit 510 located at the upstream position with respect to the direction of conveyance of the sheet P. The first cleaning mechanism 100 includes a cleaning roller 110, a paper powder absorption shaft 120, and a paper powder removal member 130.

The cleaning roller 110 is provided in a rotatable manner so as to slidably contact the photosensitive drum 53 and temporarily collects the paper powder and the toner T that adhere to the photosensitive drum 53. Specifically, a negative voltage is applied to the cleaning roller 110 during a printing operation, whereby the cleaning roller 110 attracts and holds positive toner T that still remains on the photosensitive drum 53 without being transferred to the sheet P from the photosensitive drum 53. Herein, the toner T that still remains on the photosensitive drum 53 is referred to also as "residual transfer toner T".

The positive voltage higher than the electric potential of the surface of the photosensitive drum 53 is applied to the cleaning roller 110 at a specific timing other than the period of the printing operation, whereby the residual transfer toner T held by the cleaning roller 110 is returned to the photosensitive drum 53. At this time, the positive voltage higher than the surface potential of the development roller 63 is applied to the photosensitive drum 53, whereby the positive residual transfer toner T is collected from the surface of the photosensitive drum 53 to the development roller 63.

In addition, at this time, the negatively-charged paper powder adhering to the surface of the photosensitive drum 53 is attracted and held by the cleaning roller 110 applied with the positive voltage.

The paper powder absorption shaft 120 is rotatably disposed at a position that is obliquely upward in a rearward direction with respect to the cleaning roller 110 and attracts and absorbs the paper powder held on the cleaning roller 110. Specifically, during a printing operation, a negative voltage whose absolute value is smaller than the negative voltage applied to the cleaning roller 110 is applied to the paper powder absorption shaft 120. As a result, an electric potential of the paper powder absorption shaft 120 becomes higher than an electric potential of the cleaning roller 110. Hence, the positive residual transfer toner T on the cleaning roller 110 does not move to the paper powder absorption shaft 120 having a higher electric potential and well held on the cleaning roller 110.

A positive voltage greater than the positive voltage applied to the cleaning roller 110 is applied to the paper powder absorption shaft 120 at a specific timing other than the period of the printing operation. As a result, the electric potential of the paper powder absorption shaft 120 becomes higher than the electric potential of the cleaning roller 110. Therefore, the residual transfer toner T still on the cleaning roller 110 does not move to the paper powder absorption shaft 120, and only the negatively-charged paper powder held on the cleaning roller 110 is attracted and held by the paper powder absorption shaft 120 having a higher electric potential.

The paper powder removal member 130 is formed from an elastic member, such as a sponge or a felt. The paper powder removal member 130 is disposed so as to slidably contact with the surface of the paper dust absorption shaft 120 at a position that is obliquely upward in a rearward direction with respect to the paper powder absorption shaft 120. Therefore, when paper powder is held on the paper powder absorption shaft 120, the paper powder is scraped off by the paper powder removal member 130, to thus fall. A paper powder receiving section 51A having the shape of a closed-end cylinder for receiving falling paper powder is formed as a portion of the drum unit 510 at a position below the paper powder removal member 130.

The second cleaning mechanism 200 is provided in the three drum units 51 except the most upstream drum unit 510. The second cleaning mechanism 200 has a cleaning roller 210. The cleaning roller 210 is rotatably provided so as to slidably contact the photosensitive drum 53. When applied with a voltage similar to that applied to the cleaning roller 110 of the first cleaning mechanism 100, the cleaning roller temporarily collects the residual transfer toner T adhering to the surface of the photosensitive drum 53.

The cleaning roller 210 has a diameter greater than that of the cleaning roller 110 of the first cleaning mechanism 100. Therefore, the cleaning rollers 210 except the most upstream cleaning roller are superior to the most upstream cleaning roller 110 in terms of the capability of collecting of the residual transfer toner T.

Next, operation of the first cleaning mechanism 100 and operation of the second cleaning mechanism 200 will be described with reference to FIGS. 3A and 3B. In the drawings, FIG. 3A is a cross-sectional view showing operations of the cleaning mechanisms during printing operation, and FIG. 3B is a cross-sectional view showing operations of the cleaning mechanisms at a specific timing other than the printing operation.

Figure 3A:
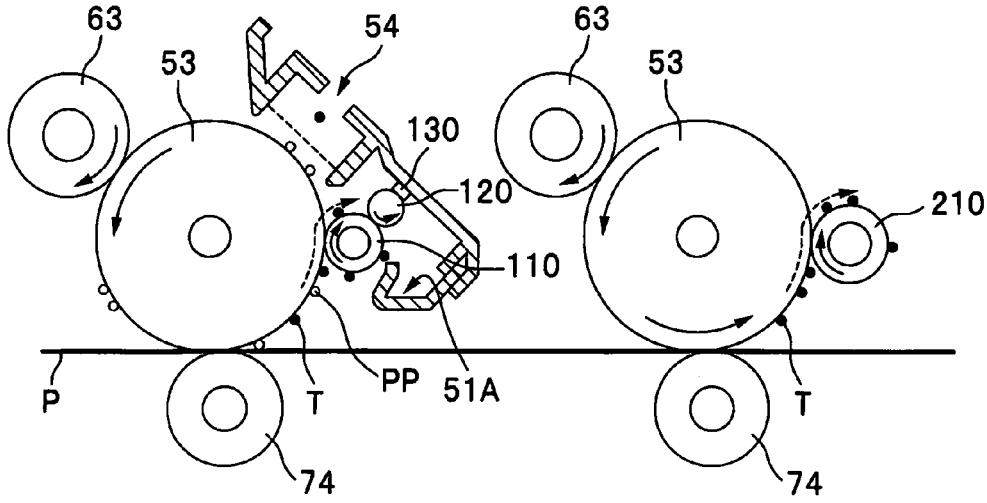
FIG. 3A is a cross-sectional view showing operation of cleaning mechanisms during printing operation.
Figure 3B:
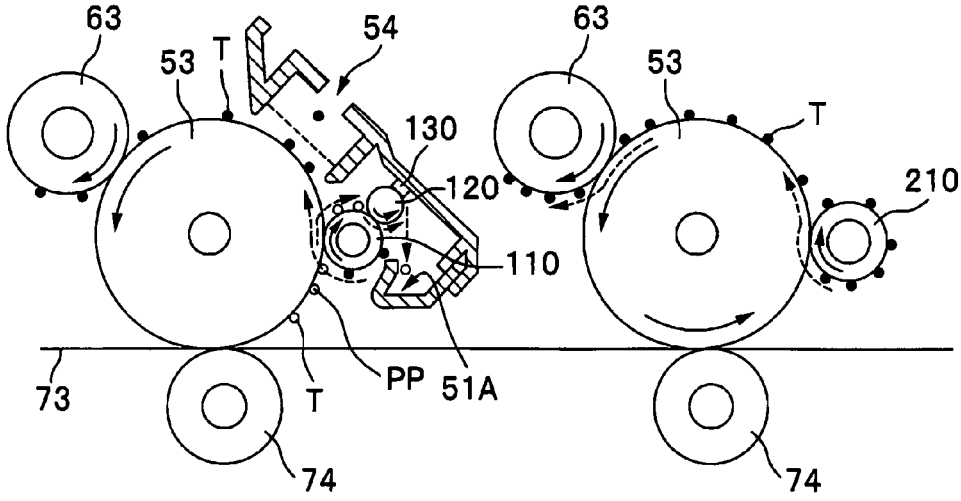
FIG. 3B is a cross-sectional view showing operation of the cleaning mechanism achieved at a specific timing other than the printing operation.

As shown in FIG. 3A, when the sheet P reaches a point between the most upstream photosensitive drum 53 and the corresponding transfer, roller 74 during printing operation, a toner image of black color is transferred onto the sheet P at that point. In the meantime, the toner T not separated by the transfer roller 74 remains as the residual transfer toner T on the photosensitive drum 53. The residual transfer toner T; however, is collected by the cleaning roller 110 that is located downstream with respect to the direction of rotation of the photosensitive drum 53 and that is negatively charged. As described above, the paper powder absorption shaft 120 is applied with a negative voltage whose absolute value is smaller than that of the negative voltage applied to the cleaning roller 110. Hence, the residual transfer toner T moves to neither the photosensitive drum 53 nor the paper powder absorption shaft 120 and is held on the cleaning roller 110.

Moreover, when the negatively-charged paper powder PP occurs from the sheet P, the paper powder PP adheres to the positively-charged photosensitive drum 53. The paper powder PP on the photosensitive drum 53 is not transferred to the negatively-charged cleaning roller 110 but is moved along with the photosensitive drum 53.

When the surface of the photosensitive drum 53 is electrified by the electrifier 54 and exposed by the LED unit 40 (see FIG. 1), the negative paper powder PP moving along with the photosensitive drum 53 is held in an unexposed area of the surface of the photosensitive drum 53 where a high electric potential is achieved. The electric potential of the unexposed area is set to a value that is higher than the surface potential (the electric potential of the toner T) of the development roller 63 so that the toner T does not move from the development roller 63. Therefore, when the paper powder PP comes to the location of the development roller 63, the negative paper powder PP is held on the unexposed area having a positive electric potential higher than that of the development roller 63. Specifically, during printing operation, the paper powder PP still remains adhering to the surface of the photosensitive drum 53.

At this time, the second and subsequent cleaning rollers 210 from the most upstream cleaning roller collects the residual transfer toner T similarly to the most upstream cleaning roller 110. Here, the most of the paper powder PP on the sheet P has already been collected by the most upstream photosensitive drum 53, and therefore, the paper powder PP does not substantially adhere to the second and subsequent photosensitive drums 53 from the most upstream photosensitive drum.

At a specific timing (e.g., timing achieved immediately after completion of printing operation) other than the period of printing operation, a positive voltage greater than the surface potential of the photosensitive drum 53 is applied to the cleaning roller 110, and a positive voltage greater than the voltage applied to the cleaning roller 110 is applied to the paper powder absorption shaft 120. As a result, as shown in FIG. 3B, the residual transfer toner T on the cleaning roller 110 moves to the photosensitive drum 53, and the thus-moved toner is conveyed by the photosensitive drum 53 and collected by the developing roller 63 whose electric potential is lower than the electric potential of the photosensitive drum 53. Similarly, the residual transfer toner T is collected by the developing rollers 63 by the photosensitive drums 53 in the second and subsequent cleaning rollers 210 from the most upstream cleaning roller, as well.

At this time, after the negative paper powder PP held on the most upstream photosensitive drum 53 moves onto the positive cleaning roller 110, the negative paper powder further moves to the paper powder absorption shaft 120 that is higher in electric potential than the cleaning roller 110. The paper powder PP on the paper powder absorption shaft 120 is scraped off by the paper powder removal member 130, to thus fall. The thus-falling paper powder is received by the paper powder receiving section 51A.

According to the above configuration, the following advantages can be obtained.

Since the paper powder absorption shaft 120 is provided for the most upstream photosensitive drum 53, the most upstream photosensitive drum 53 which receives the maximum influence from the paper powder PP can be well cleaned. Further, the second and subsequent photosensitive drums from the most upstream photosensitive drum is not provided with the paper powder absorption shaft 120, and therefore, the overall size of the printer can be reduced.

Black color of toner T whose residual achieved after transfer operation will be minimized in quantity is accommodated in the most upstream developing cartridge 61. In other words, the most upstream developing cartridge 61 accommodates the black color of toner T having a property of remaining on the corresponding photosensitive drum 53 least among the toner T accommodated in the four developing cartridges 61. As a result, a large quantity of residual transfer toner T does not adhere to the surface of the photosensitive drum 53. Therefore, collecting of the residual transfer toner T and collecting of the paper powder PP can be efficiently performed by the cleaning roller 110. Further, since the large quantity of residual transfer toner T does not adhere to the surface of the photosensitive drum 53, the cleaning roller 110 can be made small, and the paper powder absorption shaft 120 and the paper powder removal member 130 can be arranged properly.

Since the capability of collecting toner of the cleaning rollers 210 other than the most upstream cleaning roller is superior to that of the most upstream cleaning roller 110, the second and subsequent photosensitive drums 53 that attract the residual transfer toner T in greater quantities than that attracted by the most upstream photosensitive drum 53 can be cleaned well as a result of supply of colors of toner T other than the black color of toner.

The diameter of second and subsequent cleaning rollers 210 is greater than that of the most upstream cleaning roller 110. Therefore, large quantities of residual transfer toner T on the second and subsequent photosensitive drums 53 can be well collected and held, and the size of the most upstream cleaning roller provided with the paper powder absorption shaft 120 can be reduced.

Since the paper powder removal member 130 is provided, the paper powder PP can be thoroughly removed from the paper powder absorption shaft 120.

Since the paper powder receiving section 51A is disposed below the paper powder removal member 130, the paper powder PP can be well received by the paper powder receiving section 51A.

While the present invention has been shown and described with reference to certain exemplary embodiments thereof, it will be understood by those skilled in the art that various changes in form and details may be made therein without departing from the spirit and scope of the invention as defined by the appended claims.

In the exemplary embodiment, the inventive concept of the present invention is applied to the color printer 1. However, the present invention is not limited thereto. The inventive concept of the preset invention is also applied to another image forming apparatus, for example, a copier and a multifunction machine and the like.

In the exemplary embodiment, the image is transferred to the sheet P, such as a cardboard, a postal card, OHP sheet and thin paper. However, the present invention is not limited thereto. For example, the image may be transferred to a conveyance belt in a case of direct tandem type printer, an intermediate transfer belt in a case of intermediate transfer tandem type printer, and the like.

Although the photosensitive drums 53 are used in the exemplary embodiment, the present invention is not limited thereto. For example, a belt-shaped photosensitive member may also be used.

Although the paper powder absorption shaft 120 is provided only for the most upstream process cartridge in the exemplary embodiment, the present invention is not limited thereto. For example, the paper powder absorption shaft may also be provided for the second or third upstream process cartridge from the most upstream process cartridge, so long as the paper powder absorption shaft 120 is not provided for the most downstream process cartridge. That is, at least the most upstream cleaning roller among the cleaning rollers other than the most downstream cleaning roller has to be equipped with a paper powder absorption shaft.

Although the developing cartridge 61 having the developing roller 63, or the like, is used in the exemplary embodiment, the present invention is not limited thereto. A toner cartridge that is not provided with a developing roller, or the like, and in which only a toner accommodating chamber is formed or the process cartridges 50 and 500 described in connection with the exemplary embodiment may also be used.

Although in the exemplary embodiment the black color of toner T is though to be remained on the corresponding photosensitive drum after transfer operation least among the plurality of colors, the present invention is not limited thereto. Colors of toner other than the black color may also be used according to the types of toner.

Although the second and subsequent cleaning rollers 210 are superior to the most upstream cleaning roller 110 in terms of the capability of collecting toner by changing the diameters of the respective cleaning rollers 110 and 210 in the exemplary embodiment, the present invention is not limited thereto. The cleaning rollers may also be made different from each other in terms of the capability of collecting toner by changing; for example, a material of the roller.

What is claimed is:

1. An image forming apparatus comprising:

a plurality of photosensitive members, each of which is aligned along a conveying direction of a transfer medium and on each of which an electrostatic latent image is to be formed;

a plurality of developing units, each of which supplies a plurality of colors of developing agent to the photosensitive members, respectively; and a plurality of cleaning rollers, each of which slidably contacts the photosensitive members to collect at least one of paper powder and developing agent adhering to surfaces of the photosensitive members, respectively, wherein a most upstream cleaning roller which slidably contacts a most upstream photosensitive member in the conveying direction is provided with a paper powder absorption shaft which attracts and absorbs paper powder from the cleaning roller, and wherein a most downstream cleaning roller which slidably contacts a most downstream photosensitive member in the conveying direction is not provided with the paper powder absorption shaft.

2. The image forming apparatus according to claim 1, wherein the paper powder absorption shaft is provided only for the most upstream cleaning roller in the conveying direction.

3. The image forming apparatus according to claim 2, wherein a most upstream developing unit in the conveying direction accommodates developing agent which has a property of remaining on a photosensitive member after transfer operation least among the plurality of colors of developing agents.

4. The image forming apparatus according to claim 3, wherein a capability of collecting the developing agent of the cleaning rollers other than the most upstream cleaning roller is superior to that of the most upstream cleaning roller.

5. The image forming apparatus according to claim 4, wherein a diameter of the cleaning rollers other than the most upstream cleaning roller is greater than that of the most upstream cleaning roller.

6. The image forming apparatus according to claim 3, wherein a most upstream developing unit in the conveying direction accommodates developing agent of black color.

7. The image forming apparatus according to claim 1, further comprising a paper powder removal member that contacts the paper powder absorption shaft to scrape off the paper powder attracted by the paper powder absorption shaft.

8. The image forming apparatus according claim 7, further comprising a paper powder receiving unit which receives the paper powder scraped by the paper powder removal member.

9. An image forming apparatus comprising:

a transfer unit which conveys a transferred medium in a conveying direction;

first and second photosensitive members which are aligned in the conveying direction, wherein the first photosensitive member is disposed upstream from the second photosensitive member in the conveying direction;

first and second developing units which supply toner to the first and second photosensitive members, respectively; and first and second cleaning units which are provided for the first and second photosensitive members to clean the first and second photosensitive members, respectively, wherein the first cleaning unit includes a plurality of rollers, and the second cleaning unit includes at least one roller, and wherein the number of rollers in the first cleaning unit is larger than the number of rollers in the second cleaning unit.

10. The image forming apparatus according to claim 9, wherein each of the first and second cleaning units includes a cleaning roller which contacts the corresponding photosensitive member and is configured to attract and hold toner or paper powder, wherein the first cleaning unit includes a paper powder absorption shaft which contacts the cleaning roller of the first cleaning unit and is configured to attract the paper powder held by the cleaning roller of the first cleaning unit, and wherein the second cleaning unit does not includes the paper powder absorption shaft.

11. The image forming apparatus according to claim 9, wherein a voltage applied to cleaning rollers of the first and second cleaning units is changed at a specific timing other than during a printing operation.

12. The image forming apparatus according to claim 10, wherein a voltage applied to the paper powder absorption shaft is set so that only the paper powder is attracted.

* * * * *